US005928987A

United States Patent [19]

Tsugawa et al.

[11] Patent Number: 5,928,987

[45] Date of Patent: Jul. 27, 1999

[54] THERMAL RECORDING MATERIAL

[75] Inventors: Hiroaki Tsugawa, Chiba-ken; Shin Nozaki; Kaoru Izumi, both of Saitama-ken; Chitoshi Imaji, Chiba-ken; Youichi Sone; Takashi Muroi, both of Saitama-ken, all of Japan

[73] Assignee: Nippon Kayaku Co., Ltd., Tokyo, Japan

[21] Appl. No.: 08/874,110

[22] Filed: Jun. 12, 1997

[30] Foreign Application Priority Data

Jun. 14, 1996 [JP] Japan ..... 8-174424

[51] Int. Cl.[6] ..... B41M 5/40

[52] U.S. Cl. ..... 503/200; 428/304.4

[58] Field of Search ..... 427/150–152; 428/304.4; 503/200, 226

[56] References Cited

FOREIGN PATENT DOCUMENTS

| | | | |
|---|---|---|---|
| 0 345 419 | 12/1989 | European Pat. Off. | 503/200 |
| 0 476 508 | 3/1992 | European Pat. Off. | 503/200 |
| 0 812 702 | 12/1997 | European Pat. Off. | 503/200 |
| 4-107075 | 9/1992 | Japan | 503/200 |
| 4-107076 | 9/1992 | Japan | 503/200 |
| 6-48034 | 2/1994 | Japan | 503/200 |
| 6-127119 | 5/1994 | Japan | 503/200 |
| 6-227152 | 8/1994 | Japan | 503/200 |
| 3005613 | 10/1994 | Japan | 503/200 |
| 6-305257 | 11/1994 | Japan | 503/200 |
| 7-242061 | 9/1995 | Japan | 503/200 |
| 8-106250 | 4/1996 | Japan | 503/200 |
| 2 198 856 | 6/1988 | United Kingdom | 503/200 |
| 2 227 331 | 7/1990 | United Kingdom | 503/200 |

OTHER PUBLICATIONS

DATABASE WPI, Section Ch, Week 8844, Derwent Publications Ltd., XP002036517.

Copy of the European Search Report dated Aug. 14, 1997.

*Primary Examiner*—Bruce H. Hess

*Attorney, Agent, or Firm*—Nields, Lemack & Dingman

[57] ABSTRACT

A thermal recording material composed of a support of foamed polystyrene sheet and a thermal color-developing layer formed thereon. It is highly sensitive and superior in image durability, with a low level of fogging by heat. When it is used as labels for polystyrene food containers and packages, it permits their recycling without necessity of removing labels. In addition, it has good water resistance owing to corona treatment on the foamed polystyrene sheet.

8 Claims, No Drawings

THERMAL RECORDING MATERIAL

BACKGROUND OF THE INVENTION

1. Field of the Invention

The present invention relates to a thermal recording material and, more particularly, to a thermal recording material superior in color developing properties, color developing sensitivity (with a low level of fogging by heat), and durability (or resistance to plasticizer, oil, and water).

2. Description of the Related Art

There is known the thermal recording material which is based on a colorless or light-colored color former and a developer which causes the color former to develop a color upon heating. It is publicized in Japanese Patent Publication Nos. 4160/1968 and 14039/1970 and is in general practical use. The thermal recording material is usually composed of a support and a coating layer formed thereon. The support is paper, film, synthetic paper, or the like. The coating layer is formed from a solution in which are dispersed a leuco dye and a developer (of phenol derivative) in the form of fine particles. The solution also contains additives such as binding material, sensitizer, filler, and slip agent. Upon heating, either or both of the leuco dye and developer melt and come into contact with each other to bring about chemical reactions and develop a color for visible recording. The thermal recording material is prepared usually in the form of sheet. The color development of such thermal recording sheet is accomplished by means of a thermal printer provided with a thermal head. The thermal recording method has an advantage over other recording methods in (1) freedom from noise at the time of recording, (2) dispensability with development and fixing, (3) dispensability with maintenance, and (4) comparatively low machine price. Because of this advantage, it has gained wide acceptance in the fields of facsimile, computer output, calculator printer, medical instrument recorder, ticket vending machine, label printer, etc.

One of the major applications of the thermal recording is in the field of labels and price tags used in retail stores and supermarkets where the POS system has generally been accepted. However, thermosensitive labels attached to fresh produce and processed foods (such as box lunch) suffer the disadvantage of being discolored or becoming fogged. Discoloration (or disappearance of images) is due to plasticizer oozing out from the wrapping film or oils and fats leaking from the package. Fogging (or color development in the unprinted areas) is due to heating (for thawing) or humidity.

There is an increasing demand for a new thermal recording material to meet the requirement for high-speed recording. A problem to be solved for the development of such a new thermal recording material is that increased sensitivity (or improved thermal response) is offset by fogging. In addition, stabilizers to improve the resistance to plasticizer and oil are usually liable to decrease sensitivity and cause fogging. No satisfactory thermal recording materials have been completed yet which have improved thermal response, improved durability, and improved resistance to fog by heat and moisture.

Improvement of thermal response by supercalendering (to enhance smoothness) is mentioned in Japanese Patent Publication No. 20142/1977. Unfortunately, supercalendering needs complex operation and smooth surface is poor in compatibility with the thermal head. Also, improvement of thermal response by the use of a leuco dye having a low melting point is disclosed in Japanese Patent Laid-open No. 164890/1981. Unfortunately, improvement in this way is offset by increased heat fogging. There is another way of improving thermal response by interposing an intermediate layer between the support and the thermal recording layer, as disclosed in Japanese Patent Laid-open Nos. 5093/1984, 248390/1985, 113282/1989, and 214688/1990. The disadvantage of this method is the incomplete adhesion between the support and the thermal recording layer which leads to peeling by external force or under wet conditions.

Conventional thermal labels made of paper, synthetic paper, or polyester film pose a problem with their removal when containers or packaging materials of polystyrene or foamed polystyrene are recovered for recycling. To address this problem, using polystyrene film as the support for the thermal recording material has been proposed in Japanese Patent Laid-open No. 242061/1995. The disadvantage of this idea is that the color density is insufficient if the printing energy is low, which hampers the high-speed printing.

OBJECT AND SUMMARY OF THE INVENTION

The present invention was completed in order to address the above-mentioned problems involved in the prior art technology. It is an object of the present invention to provide a thermal recording material which is superior in sensitivity and image durability, has good resistance to heat and moisture, and can be easily recycled.

In order to eliminate the above-mentioned disadvantages involved in the prior art technology, the present inventors carried out a series of researches, which led to the present invention.

The present invention covers:

(1) A thermal recording material which comprises a support of foamed polystyrene sheet and a thermal color developing layer formed thereon which contains a substance capable of color development upon heating.

(2) A thermal recording material as defined in (1) above, wherein the foamed polystyrene sheet has a surface with a wetting surface tension greater than 35 dyn/cm.

(3) A thermal recording material as defined in (2) above, wherein the foamed polystyrene sheet has its surface corona-treated.

(4) A thermal recording material as defined in any of (1) to (3) above, wherein the substance capable of color development upon heating is composed of a colorless or light-colored color-forming compound and a color-developing compound to cause said color-forming compound to develop a color upon heating.

(5) A thermal recording material as defined in any of (1) to (4) above, wherein the foamed polystyrene sheet is one which has undergone biaxial orientation.

(6) A thermal recording material as defined in any of (1) to (5) above, wherein the foamed polystyrene sheet has an apparent density of 0.7 to 0.02 g/cm$^3$.

(7) A thermal recording material as defined in any of (1) to (6) above, wherein the thermal color developing layer contains a binding material which is a styrene polymer.

(8) A thermal recording material as defined in any of (1) to (7) above, wherein the support of foamed polystyrene sheet has the thermal color developing layer on one side thereof and an adhesive layer on the other side thereof.

(9) An adhesive label made of a thermal recording material defined in (8) above.

DESCRIPTION OF THE PREFERRED EMBODIMENTS

The thermal recording material of the present invention is composed of a support of foamed polystyrene sheet and a thermal color developing layer formed thereon which contains a substance capable of color development upon heating. According to the present invention, the thermal color developing layer may optionally contain a binding material, filler, heat-fusible compound, slip agent, surface active agent, etc. in addition to the above-mentioned substance capable of color development upon heating. The substance capable of color development upon heating includes a color-forming compound and a color-developing compound illustrated in the following.

According to the present invention, the support is coated with a solution of the above-mentioned materials so as to form the thermal color developing layer which has a dry basis weight of 1–40 g/m$^2$, preferably 5–15 g/m$^2$. An optional intermediate layer may be formed between the support and the thermal color developing layer. In addition, an optional protective layer may be formed on the thermal color developing layer.

The thermal color-developing layer may be composed of the following components. Color-forming compound: 1–50 wt %. Color-developing compound: 5–80 wt %. Binding material: 1–90 wt %. Filler: 0–80 wt %. Heat-fusible compound: 0–80 wt %. Slip agent and surface active agent: as much as necessary The intermediate layer and protective layer may be composed of the above-mentioned binding material (and optional filler) in any amount desired. The dry basis weight of these layers should be lower than 6 g/m$^2$.

According to the present invention, the substrate is a foamed polystyrene sheet which is obtained by biaxial orientation used for the fabrication of ordinary polystyrene paper. It is composed of polystyrene as the major constituent (99.5–94 wt %) and a foaming agent such as butane (0.5–6 wt %). It has an apparent density of 0.7–0.02 g/cm$^3$, and it is 100–3000 $\mu$m thick. It is commercially available under a trade name of U-pearl from Pearl Package Co., Ltd.

According to the present invention, the foamed polystyrene sheet should have a surface with a wetting surface tension higher than 35 dyn/cm, preferably higher than 40 dyn/cm, and more preferably higher than 50 dyn/cm, so that it permits the thermal color developing layer to be formed thereon. Commercial foamed polystyrene sheet has a surface with a wetting surface tension of about 30 dyn/cm. It is possible to increase the wetting surface tension as desired by corona treatment or by coating with a surface active agent. Corona treatment is preferable. Corona treatment increases the wetting surface tension and improves the water resistance of the product. Incidentally, the wetting surface tension is measured according to the test method specified in JIS(Japanese Industrial Standard) K-6768 (1977).

The color-forming compound used for the thermal color-developing layer is not specifically restricted but is selected from those which are commonly used for pressure-sensitive recording paper and thermal recording paper. It includes, for example, fluoran compounds, triarylmethane compounds, spiro compounds, diphenylmethane compounds, thiazine compounds, lactum compounds, and fluorene compounds.

Examples of fluoran compounds are listed below.

3-diethylamino-6-methyl-7-anilinofluoran,
3-dibutylamino-6-methyl-7-anilinofluoran,
3-(N-methyl-N-cyclohexylamino)-6-methyl-7-anilinofluoran,
3-(N-ethyl-N-isopentylamino)-6-methyl-7-anilinofluoran,
3-isobutylethylamino-6-methyl-7-anilinofluoran,
3-[N-ethyl-N-(3-ethoxypropyl)amino]-6-methyl-7-anilinofluoran,
3-(N-ethyl-N-hexylamino)-6-methyl-7-anilinofluoran,
3-dipentylamino-6-methyl-7-anilinofluoran,
3-(N-methyl-N-propylamino)-6-methyl-7-anilinofluoran,
3-(N-ethyl-N-tetrahydrofurylamino)-6-methyl-7-anilinofluoran,
3-diethylamino-6-methyl-7-(p-chloroanilino)fluoran,
3-diethylamino-6-methyl-7-(p-fluoroanilino)fluoran,
3-(p-toluidinoethylamino)-6-methyl-7-anilinofluoran,
3-diethylamino-6-methyl-7-(p-toluidino)fluoran,
3-diethylamino-7-(o-chloroanilino)fluoran
3-dibutylamino-7-(o-chloroanilino)fluoran
3-diethylamino-7-(o-fluoroanilino)fluoran
3-dibutylamino-7-(o-fluoroanilino)fluoran
3-diethylamino-7-(3,4-dichloroanilino)fluoran,
3-pyrrolidino-6-methyl-7-anilinofluoran,
3-diethylamino-6-chloro-7-ethoxyethylaminofluoran,
3-diethylamino-6-chloro-7-anilinofluoran,
3-diethylamino-7-chlorofluoran,
3-diethylamino-6-chloro-7-methylfluoran,
3-diethylamino-7-methylfluoran,
3-diethylamino-7-octyalaminofluoran,
3-diethylamino-7-phenylfluoran, and
3-(p-toluidinoethylamino)-6-methyl-7-phenetylfluoran.

Examples of triarylmethane compounds are listed below.

3,3-bis(p-dimethylaminophenyl)-6-dimethylaminophthalide (synonym for crystal violet lactone or CVL)
3,3-bis(p-dimethylaminophenyl)phthalide,
3-(p-dimethylaminophenyl)-3-(1,2-dimethylaminoindol-3-yl)phthalide,
3-(p-dimethylaminophenyl)-3-(2-methylindol-3-yl) phthalide,
3-(p-dimethylaminophenyl)-3-(2-phenylindol-3-yl) phthalide,
3,3-bis(1,2-dimethylindol-3-yl)-5-dimethylaminophthalide,
3,3-bis(1,2-dimethylindol-3-yl)-6-dimethylaminophthalide,
3,3-bis(9-ethylcarbozol-3-yl)-5-dimethylaminophthalide,
3,3-(2-phenylindol-3-yl)-5-dimethylaminophthalide, and
3-p-dimethylaminophenyl-3-(1-methylpyrrol-2-yl)-6-dimethylaminophthalide.

Examples of the Spiro compounds are listed below.

3-methylspirodinaphthopyran,
3-ethylspirodinaphthopyran,
3,3'-dichlorospirodinaphthopyran,
3-benzylspirodinaphthopyran,
3-propylspirobenzopyran,
3-methylnaphtho-(3-methoxybenzo)spiropyran, and
1,3,3-trimethyl-6-nitro-8'-methoxyspiro(indolin-2,2'-benzopyran).

Examples of the diphenylmethane compounds are listed below.

N-halophenyl-leuco-auramine,
4,4-bis-dimethylaminophenylbenzhydrylbenzylether, and
N-2,4,5-trichlorophenyl-leuco-auramine.

Examples of the thiazine compounds are listed below.

benzoyl-leuco-methyleneblue, and
p-nitrobenzoyl-leuco-methyleneblue.

Examples of the lactum compounds are listed below. rhodamine B anilinolactum, and rhodamine B-p-chloroanilinolactum.

Examples of the fluorene compounds are listed below.

3,6-bis(dimethylamino)fluorene-spiro(9,3')-6'-dimethylaminophthalide,
3,6-bis(dimethylamino)fluorene-spiro(9,3')-6'-pyrrolidinophthalide, and
3-dimethylamino-6-diethylaminofluorene-spiro(9,3')-6'-pyrrolidinophthalide.

The above-mentioned color-forming compounds may be used alone or in combination with one another.

The color-developing compound used for the thermal color-developing layer is not specifically restricted but is selected from those which are commonly used for pressure-sensitive recording paper and thermal recording paper. Its examples are listed below.

The phenol compounds such as

α-naphthol,
β-naphthol,
p-octylphenol,
4-t-octylphenol,
p-t-butylphenol,
p-phenylphenol,
1,1-bis(p-hydroxyphenyl)propane,
2,2-bis(p-hydroxyphenyl)propane (synonym for bisphenol A or BPA),
2,2-bis(p-hydroxyphenyl)butane,
1,1-bis(p-hydroxyphenyl)cyclohexane,
4,4'-thiobisphenol,
4,4'-cyclohexylidenediphenol,
2,2'-(2,5-dibromo-4-hydroxyphenyl)propane,
4,4'-isopropylidenebis(2-t-butylphenol),
2,2'-methylenebis(4-chlorophenol),
4,4'-dihydroxydiphenylsulfone,
2,4'-dihydroxydiphenylsulfone,
bis (3-aryl-4-hydroxyphenyl)sulfone,
4-hydroxy-4'-methoxydiphenylsulfone,
4-hydroxy-4'-ethoxydiphenylsulfone,
4-hydroxy-4'-isopropoxydiphenylsulfone,
4-hydroxy-4'-butoxydiphenylsulfone,
methyl bis-(4-hydroxyphenyl)acetate,
butyl bis-(4-hydroxyphenyl)acetate,
benzyl bis-(4-hydroxyphenyl)acetate,
2,4-dihydroxy-2'-methoxybenzanilide;

The aromatic carboxylic acid esters such as benzyl p-hydro xybenzoate,
ethyl p-hydroxybenzoate,
dibenzyl 4-hydroxyphthalate,
dimethyl 4-hydroxyphthalate, ethyl 5-hydroxyisophthalate;

The aromatic carboxylic acid such as 3,5-di-t-butylsalicylic acid,
3,5-di-α-methylbenzylsalicylic acid; and metal salts of aromatic carboxylic acids.

The binding material used for the thermal color-developing layer should preferably be a styrene polymer. It includes, for example, styrene/maleic anhydride copolymer, polystyrene, styrene/acrylic ester copolymer, styrene/acrylonitrile copolymer, styrene/butadiene copolymer, carboxylated styrene/butadiene copolymer, styrene/butadiene/acrylic acid copolymer, and a hydrophobic polymeric emulsion composed of colloidal silica and styrene copolymer composition.

Additional examples of the binding material include methyl cellulose, methoxycellulose, hydroxyethylcellulose, carboxymethylcellulose, sodium carboxymethylcellulose, polyvinyl alcohol (PVA), carboxyl group-modified polyvinyl alcohol, sulfonic acid group-modified polyvinyl alcohol, polyvinyl pyrrolidone, polyacrylamide, polyacrylic acid, starch and derivatives thereof, casein, gelatin, water-soluble isoprene rubber, water-soluble alkali salt of iso-(or diiso-) butylene/maleic anhydride copolymer, polyvinyl acetate, vinyl chloride/vinyl acetate copolymer, polyacrylate ester, polyurethane, and a hydro- phobic polymeric emulsion composed of colloidal silica and acrylic resin composition.

Examples of the filler include calcium carbonate, magnesium carbonate, magnesium oxide, silica, white carbon, talc, clay, alumina, magnesium hydroxide, aluminum hydroxide, aluminum oxide, barium sulfate, polystyrene resin, and urea-formalin resin.

Examples of the heat-fusible compound include animal and vegetable waxes and synthetic waxes (such as japan wax, carnauba wax, shellac, paraffin, montan wax, oxidized paraffin, polyethylene wax, and oxidized polyethylene); higher fatty acid (such as stearic acid and behenic acid); higher fatty amide (such as stearamide, oleamide, N-methylstearylamide, erucamide, meth- ylolbehenamide, methylolstearamide, methylenebisstearamide, and ethylenebisstearamide); higher fatty anilide (such as stearanilide and linolanilide); acetylated aromatic amine (such as acetotoluizide); naphthalene derivative (such as 1-benzyloxynaphthalene, 2-benzyloxynaphthalene, and phenyl 1-hydroxynaphthoate); aromatic ether (such as 1,2-diphenoxyethane, 1,4-diphenoxyethane, 1,2-bis(3-methylphenoxy)ethane, 1,2-bis(4-methoxyphenoxy)ethane, 1,2-bis(3,4-dimethylpenyl)ethane, 1-phenoxy-2-(4-chlorophenoxy)ethane, and 1-phenoxy-2-(4-methoxyphenoxy)ethane); aromatic carboxylic acid derivative (such as benzyl p-hydroxybenzoate, benzyl p-benzyloxybenzoate, and dibenzyl terephthalate); aromatic sulfonic ester derivative (such as phenyl p-toluenesulfonate, phenyl mesitylenesulfonate, and 4-methyphenylmesitylenesulfonate); carbonic or oxalic diester derivative (such as diphenyl carbonate, dibenzyl oxalate, di(4-methylbenzyl) oxalate, and di(4-chlorobenzyl) oxalate); biphenyl derivative (such as p-benzylbiphenyl and p-aryloxybiphenyl); and terphenyl derivative (such as m-terphenyl). They should be solid at normal temperature and have a melting point higher than about 70° C.

Examples of optional additives include slip agent (such as zinc stearate, calcium stearate, and aluminum stearate), surface active agents, antifoaming agents, and UV light absorber.

The thermal recording material of the present invention is prepared from the above-mentioned materials in the following manner. First, the color-forming compound and color-developing compound are crushed and mixed separately with the binding material and optional additives using a ball mill, attritor, or sand mill (in dry process or wet process in water) in the usual way. Then, the resulting mixtures are mixed together and applied onto the support of foamed polystyrene sheet (which has previously been corona-treated) using a bar coater or blade coater to form the thermal color-developing layer (which has a dry basis weight of 1–40 g/m$^2$). Finally, the coated sheet is dried. Incidentally, the mixing ratio of the color-forming compound and color-developing compound should be from 2:1 to 1:10.

The corona treatment of foamed polystyrene sheet may be carried out in the usual way by passing foamed polystyrene sheet at a rate of 5–200 m/min, preferably 10–100 m/min, through a gap (about 0.5–2 mm) between an electrode (connected to a high-voltage generator) and a metal roll covered with polyester film, Hypalon, or EP rubber, across which is applied a high voltage (of the order of thousands to ten thousands) at a high frequency of hundreds of kHz. This corona treatment should be carried out in air, carbon dioxide gas, or nitrogen gas.

If necessary, an optional intermediate layer may be formed between the support and the thermal color-developing layer or an optional overcoating layer may be formed on the thermal color-developing layer.

The thermal recording material of the present invention is characterized by high recording density or high recording speed by a thermal printer because the support of polystyrene sheet (on which is formed the thermal color-developing layer) produces the heat-insulating effect. This makes it unnecessary to excessively increase the thermal response of the thermal recording layer per se. This in turn leads to good durability and freedom from fogging by heat and moisture.

The thermal recording material of the present invention is used mainly in the form of adhesive label having an adhesive layer on the back of the support. The adhesive layer may be formed from any known adhesive of solvent type (such as vinyl acetate resin, vinyl chloride resin, and acrylic resin), heat-sensitive type (such as ethylene-vinyl acetate copolymer, polyolefin resin, polyamide resin, and polyester resin), or pressure-sensitive type (such as rubber, acrylic resin, silicone resin, and polyvinyl ether resin). Pressure-sensitive adhesives are desirable because of their good handling properties.

The adhesive layer should be 3–100 μm thick, preferably 10–50 μm thick.

There are two methods of forming the adhesive layer. The first one is the direct coating method, which consists of applying an adhesive solution directly to the support and then drying it. The second one is the transfer method, which consists of applying an adhesive solution to the release surface of a release sheet and, after drying, transferring the adhesive layer to the support. In the present invention, the second method is preferable because it does not heat the support.

When used as adhesive labels for polystyrene trays and containers, the thermal recording material of the present invention offers the advantage of obviating the necessity of removing them from the containers and packages to be recycled.

In addition, the thermal recording material of the present invention may be used, after printing, as a packaging or cushioning material for glass, ceramics, or plastics containers (by taking advantage of the cushioning properties of foamed polystyrene). In this way it is possible to eliminate the necessity of printing or labeling.

EXAMPLES

The invention will be described in more detail with reference to the following examples, which are not intended to restrict the scope of the invention. In Examples, "parts" means "parts by weight".

Example 1

Solutions [A] and [B] were prepared from the following components by crushing and dispersion using a sand grinder so that the crushed particles had an average diameter smaller than 2 μm.

Solution [A]

3-dibutylamino-6-methyl-7-anilinofluoran 25 parts

25% aqueous solution of PVA 20 parts

Water 55 parts

Solution [B]

4-hydroxy-4'-isopropoxydiphenylsulfone 25 parts

25% aqueous solution of PVA 20 parts

Water 55 parts

The resulting solutions [A] and [B] were mixed in the following ratio to give a coating solution for the thermal color-developing layer with a dry basis weight of about 6 g/m$^2$. The coating solution was applied to a corona-treated foamed polystyrene sheet specified as follows.

Thickness: 180 μm

Apparent density: about 0.3 g/cm$^3$

Wetting surface tension before corona treatment: about 32 dyn/cm

Wetting surface tension after corona treatment: about 50 dyn/cm

Solution [A] 8 parts

Solution [B] 24 parts

50% dispersion of calcium carbonate 40 parts

48% latex of carboxylated styrene-butadiene copolymer 6 parts

Water 20 parts

The thermal color-developing layer was coated with the solution specified below to form a protective layer (with a dry basis weight of about 3 g/m$^2$).

15% aqueous solution of PVA 100 parts

50% dispersion of clay 10 parts

30% aqueous solution of glyoxal 1 part

After drying, there was obtained the desired thermal recording material.

Example 2

The same procedure as in Example 1 was repeated except that the first component for solution [B] was replaced by bis(3-allyl-4-hydroxyphenyl)sulfone.

Example 3

Solutions [C] and [D] were prepared from the following components by crushing and dispersion using a sand grinder so that the crushed particles had an average diameter smaller than 2 μm.

Solution [C]

3-dibutylamino-7-(o-chloroanilino)fluoran 25 parts

25% aqueous solution of PVA 20 parts

Water 55 parts

Solution [D]

Bisphenol A 25 parts

25% aqueous solution of PVA 20 parts

Water 55 parts

The resulting solutions [C] and [D] were mixed in the following ratio to give a coating solution for the thermal color-developing layer in the same manner as in Example 1. Thus there was obtained the desired thermal recording material.

Solution [C] 8 parts

Solution [D] 20 parts

20% dispersion of methylol stearamide 16 parts

50% dispersion of calcium carbonate 40 parts

48% latex of carboxylated styrene-butadiene copolymer 6 parts

Water 20 parts

Example 4

The same procedure as in Example 1 was repeated except that the corona-treated foamed polystyrene sheet was replaced by the one which has a wetting surface tension of about 40 dyn/cm.

Example 5

The same procedure as in Example 1 was repeated except that the corona-treated foamed polystyrene sheet was replaced by the one which has an apparent density of about 0.15 g/cm$^3$.

Example 6

The same procedure as in Example 1 was repeated except that the corona-treated foamed polystyrene sheet was replaced by the one which has an apparent density of about 0.5 g/cm$^3$.

Example 7

A release sheet was coated with an acrylic pressure-sensitive adhesive ("PA-T1" from LINTEC Corporation) to form a 20 μm thick adhesive layer. This adhesive layer was transferred to the back of the support of the thermal recording material prepared in Example 1. Thus there was obtained a thermal recording material with an adhesive layer.

Comparative Example 1

The same procedure as in Example 1 was repeated except that the support was replaced by corona-treated, transparent polystyrene film (without foaming) ("OPS Film", 50 μm thick, from Asahi Chemical Industry Co., Ltd.).

Comparative Example 2

Coating solution [E] for an intermediate layer was prepared from the following components.

30% latex of hollow particles (styrene/acrylate copolymer resin having an average particle diameter of 0.5 μm and a void of 55%) 83 parts 48% latex of carboxylated styrene-butadiene copolymer 17 parts Solution [E] was applied to wood-free paper (with a basis weight of 50 g/m$^2$) to form an intermediate layer (with a dry basis weight of 2 g/m$^2$). On the intermediate layer were formed the thermal color-developing layer and protective layer in the same manner as in Example 1.

The samples prepared in Examples and Comparative Examples as mentioned above were tested for performance. The results are shown in Table 1.

TABLE 1

| | Back-ground*1 | Color density*2 | Color density*3 | Resistance to heat*4 | Resistance to plasticizer | Resistance to oil*6 | Resistance to water*7 | Resistance to water*8 |
|---|---|---|---|---|---|---|---|---|
| Example 1 | 0.04 | 1.35 | 1.45 | 0.05 | 96% | 94% | 90% | good |
| Example 2 | 0.05 | 1.33 | 1.43 | 0.06 | 99% | 98% | 95% | good |
| Example 3 | 0.04 | 1.34 | 1.45 | 0.06 | 90% | 91% | 91% | good |
| Example 4 | 0.04 | 1.35 | 1.45 | 0.05 | 96% | 94% | 91% | good |
| Example 5 | 0.04 | 1.38 | 1.46 | 0.05 | 95% | 95% | 90% | good |
| Example 6 | 0.04 | 1.34 | 1.45 | 0.05 | 96% | 94% | 91% | good |
| Comparative Example 1 | 0.06 | 0.89 | 1.28 | 0.07 | 96% | 95% | 90% | poor |
| Comparative Example 2 | 0.05 | 0.70 | 1.20 | 0.06 | 95% | 94% | 78% | poor |

It is noted from Table 1 that the thermal recording material of the present invention is superior in background color, color density, and durability (or resistance to plasticizer, oil, and water) and is immune to fogging by heat. The high color density with a low printing energy and the high physical strength of image area in resistance to water are noteworthy.

[Effect of the invention]. The present invention provides a thermal recording material composed of a support of foamed polystyrene sheet and a thermal color-developing layer formed thereon. The thermal recording material is highly sensitive and superior in image durability, with a low level of fogging by heat. When it is used as labels for polystyrene food containers and packages, it permits their recycling without necessity of removing labels. In addition, it has good water resistance owing to corona treatment on the foamed polystyrene sheet.

What is claimed is:

1. A thermal recording material which comprises a support of foamed polystyrene sheet and a thermal color developing layer formed thereon which contains a substance capable of color development upon heating, and the foamed polystyrene sheet has a surface with a wetting surface tension greater than 40 dyn/cm.

2. A thermal recording material as defined in claim 1, wherein the foamed polystyrene sheet has its surface corona-treated.

3. A thermal recording material as defined in claim 1, wherein the substance capable of color development upon heating is composed of a colorless or light-colored color-forming compound and a color-developing compound to cause said color-forming compound to develop a color upon heating.

4. A thermal recording material as defined in claim 1, wherein the foamed polystyrene sheet is one which has undergone biaxial orientation.

5. A thermal recording material as defined in claim 1, wherein the foamed polystyrene sheet has an apparent density of 0.7 to 0.02 g/cm$^3$.

6. A thermal recording material as defined in claim 1, wherein the thermal color developing layer contains a binding material which is a styrene polymer.

7. A thermal recording material as defined in claim 1, wherein the support of foamed polystyrene sheet has the thermal color developing layer on one side thereof and an adhesive layer on the other side thereof.

8. An adhesive label made of a thermal recording material defined in claim 7.

* * * * *

UNITED STATES PATENT AND TRADEMARK OFFICE

CERTIFICATE OF CORRECTION

PATENT NO. : 5,928,987
DATED : July 27, 1999
INVENTOR(S) : Hiroaki Tsugawa et al.

It is certified that error appears in the above-identified patent and that said Letters Patent is hereby corrected as shown below:

Title page,
Item [73], should read as follows:
-- [73] Assignee: Nippon Kayaku Co., Ltd., Tokyo, Japan and LINTEC Corporation, Tokyo, Japan --

Signed and Sealed this

Twenty-fourth Day of December, 2002

JAMES E. ROGAN
*Director of the United States Patent and Trademark Office*